United States Patent [19]

Enneking et al.

[11] 4,030,169

[45] June 21, 1977

[54] METHOD AND APPARATUS FOR TREATING YARN

[75] Inventors: Heinrich Enneking, Karlsruhe; Günter Schubert, Malsch; Karl-Heinz Baumann, Karlsruhe, all of Germany

[73] Assignee: Industriewerke Karlsruhe Augsburg Aktiengesellschaft, Germany

[22] Filed: Feb. 11, 1976

[21] Appl. No.: 657,218

[30] Foreign Application Priority Data

Feb. 22, 1975 Germany ..... 2507752

[52] U.S. Cl. ..... 28/220; 28/256; 28/265; 28/267

[51] Int. Cl.[2] ..... D02G 1/20; D02G 1/16; D02G 1/12

[58] Field of Search ..... 28/1.3, 1.4, 1.6, 1.8, 28/72.11, 72.12, 72.14, 72.15, 220, 221, 225, 256, 265, 266, 267

[56] References Cited

UNITED STATES PATENTS

| | | | |
|---|---|---|---|
| 2,914,835 | 12/1959 | Slayter et al. | 28/1.3 |
| 3,343,240 | 9/1967 | Parmeggiani et al. | 28/1.3 |
| 3,389,445 | 6/1968 | Schreffler | 28/1.3 |
| 3,605,393 | 9/1971 | Schroeder | 28/1.3 |
| 3,859,697 | 1/1975 | Guenther | 28/1.4 |

FOREIGN PATENTS OR APPLICATIONS

| | | | |
|---|---|---|---|
| 1,352,521 | 1/1964 | France | 28/266 |
| 1,198,035 | 7/1970 | United Kingdom | 28/221 |
| 1,208,013 | 10/1970 | United Kingdom | 28/266 |
| 1,260,002 | 1/1972 | United Kingdom | 28/266 |

*Primary Examiner*—Louis K. Rimrodt

*Attorney, Agent, or Firm*—McGlew and Tuttle

[57] ABSTRACT

Method of treating synthetic threads, particularly filament or foil threads comprises heating the threads up to the center of their cross-section, crimping the heated thread, forming the crimped threads into a wadding, heating and compressing the wadding to reduce its volume and thereafter cooling the compressed wadding. An apparatus for treating the yarn includes a continuous heating chamber which is arranged adjacent a cooling chamber. An apparatus is provided for feeding the yarn to be treated toward the heating chamber and for crimping the yarn preferably while it is heated and perhaps also stretched. Crimping may be carried on by directing the thread under a fluid force against a screen, by passing the thread between a pair of rollers which have crimping means or by a combination of the two and, in addition, stretching means may be provided to stretch the thread. The device is also provided to collect the yarn in wads as it is crimped and to force it through a narrowing path so as to compress it as it is being fed through a heating chamber. The compressed wadding is thereafter fed through a cooling chamber. Wadding is advantageously moved through the heating chamber around a drum and between a drum and an exterior belt which is maintained under tension and a similar means is employed for transporting it through a second drum arranged in the cooling chamber. The apparatus may also include an endless conveyor having projecting needles which are trained to run through an elongated continuous chamber defined between two spaced walls which narrow in order to compress the wadding and which extend from the heating portion to a cooling portion.

14 Claims, 5 Drawing Figures

Fig. 2
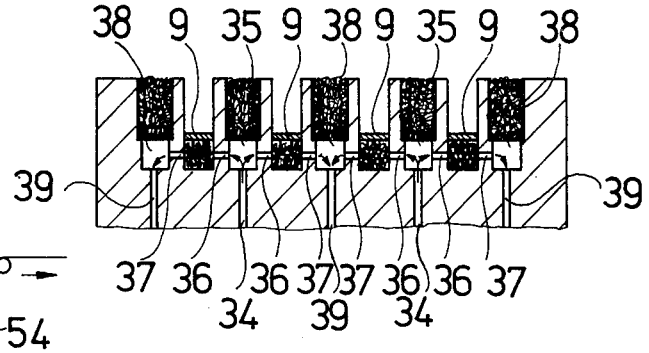
Fig. 3
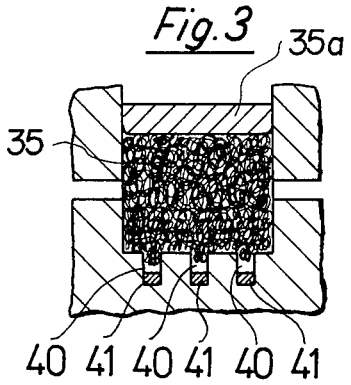
Fig. 4
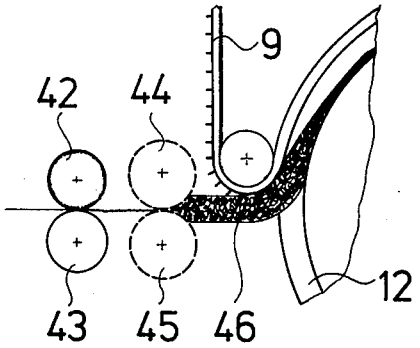
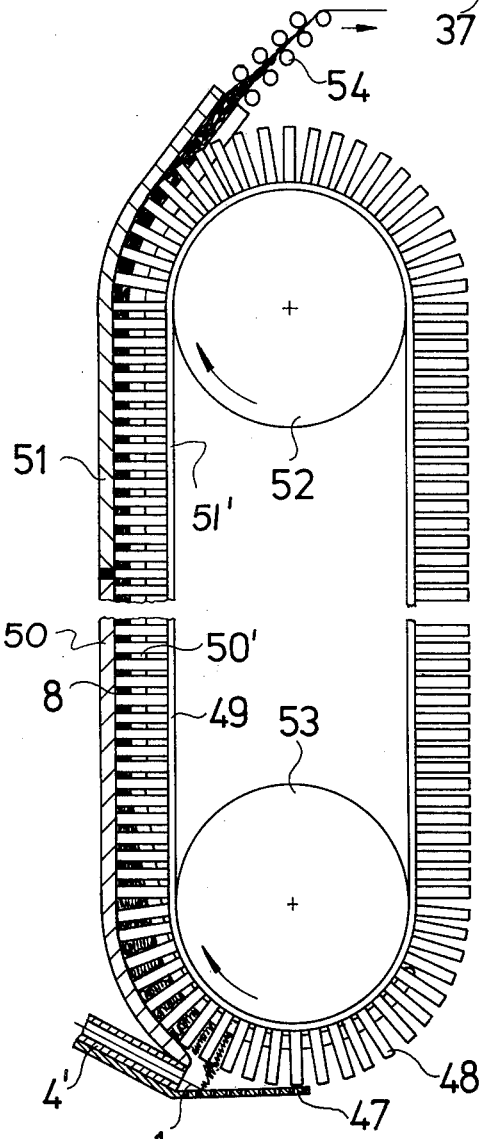
Fig. 5

METHOD AND APPARATUS FOR TREATING YARN

BACKGROUND OF THE INVENTION

1. Field of the Invention

This invention relates, in general, to a method and apparatus for treating threads and, in particular, to a new and useful method and device for crimping and subsequently cooling synthetic threads, particularly filament and foil threads.

2. Description of the Prior Art

A large number of devices and methods are already employed for crimping filament and foil threads. Garments are still crimped today, but almost exclusively according to the false wire method. In medium and coarse yarns destined for garments, the speed that can be achieved with the false wire method including the friction method are relatively low. For these and similar reasons, it has been tried to find a method which permits higher speeds, but also operates at an output sufficient for garments with a finer curved, more uniform and more stable crimp.

Methods are also known where the capillary threads are composed of two or more differently-shrinking components or which are cooled unidirectionally and crimped in a subsequent heat treatment by different shrinkage. These yarns have the disadvantage that the crimping stability is relatively low so that the risk of high crimping losses during the hard winding or during the further processing is very great. A crimping stability which is too low involves the risk of streakiness and curliness in a multifilar processing due to the varying crimping losses. Furthermore, these yarns have the disadvantage that the deformation of the capillary threads is not intensive so that the materials produced therefrom have a soapier feel than materials produced from false wire yarns.

Methods are also known where the threads are crimped in a compression chamber by a nozzle which acts to throw the thread against a baffle surface, by embossing rolls or by meshing gear wheels. The crimped yarns obtained with these methods do not melt which is a requirement for yarns used in the garment industry in most cases. This is due to substantially the fact that the crimping is too coarse and not uniform and not stable enough. In addition, the feel of the materials made therefrom is also too soapy, compared to the material made of false wire yarns.

For the production of carpet yarns on an individual scale, the following methods are used:

the compression chamber method,
the gear wheel method,
the air impact method, and
the nozzle blowing method.

For extremely high speeds, the yarns must be wound very hard. Otherwise, the bobbins will break out when the centrifugal force acting on them diminishes. In this case, a crimping loss during the winding caused by a too low crimping stability is unavoidable. The yarns thus no longer meet the quality requirements.

SUMMARY OF THE INVENTION

The invention provides a high quality yarn of great crimping stability and uniformity for use in garments as well as for carpets and upholstery materials and the yarn is treated at speeds which were not possible heretofore.

With the invention, it is possible to meet the following requirements:

a. intensive and finely curved deformation of the capillary threads;
b. uniform heating of the capillary threads up to the center of the cross-section at the time of deformation;
c. long and uniform maintenance of the intensive deformation in order to insure the necessary structural changes in the interior of the thread and
d. uniform maintenance of the intensive deformation until the thread is cooled down to a temperature close to the freezing temperature.

The known methods cannot meet all of these requirements and they are not capable of effecting intensive deformation of the capillary threads due to the different shrinkage inside the cross-section. In the known impact methods, the threads are thrown against baffle surfaces and deformed. The intensive deformation leading to crimping exists only at the time of the impact, but since this interval is extremely short at high speeds, the structural changes caused by the deformation and the interior of the thread cannot be complete. Immediately after the impact, the thread passes into a state of reduced deformation. Because this state of reduced deformation is frozen, the undulation, elongation and crimping stability of the crimped yarns produced with this method are limited. They are therefore not suitable for garments. The same disadvantages are found in the gear wheel and embossing methods, and the nozzle blowing methods. In these methods, the great bending stresses are only effective in an extremely short time interval and, particularly not in the cooling phase.

The known compression chamber methods have the general advantage that the wadding formed has a substantially higher titer than the supplied thread, so that long stay periods present no problem, even at high speeds. But these methods have the disadvantage that the supplied thread is only deposited in relatively long arcs. It is therefore impossible to obtain a fully curved crimp. These methods have furthermore the disadvantage that no extremely high compression is possible so that the absolutely necessary high bending stresses cannot be produced in the threads with relatively large crimping arcs deposited in the crimping chamber. The crimping arcs rather disappear again, with the result that they have only a low undulation, little elongation, and a low crimping stability.

If a great and particularly uniform compression of the wadding is to be achieved at high speeds, means of transportation must be provided in the heating chamber. In the compression chamber method, the wadding is first formed in a compression chamber and is fed from there into a rotating heating chamber where it is heated and transported. The compression is achieved solely by the supply into the compression chamber. The extent of the compression is therefore limited. There is no compression by subsequently reducing the wadding volume. The crimping is therefore slight and not very stable. The same holds true for other suggested compression chamber methods.

Another disadvantage of the compression chamber methods suggested so far is that the cooling is not effected in the state of extremely high compression, which is indispensable for a good crimping stability and elasticity of the yarns.

In the above-mentioned method, with a rotating heating chamber, the yarn wadding is fed to a cooling chamber after leaving the heating chamber; but since there is no means of transportation provided, the wadding cannot be passed through it uniformly in a highly compressed state over long distances. This is indispensible, however, at high speeds.

In another method, a long cooling pipe is provided for cooling the wadding. Since no means of transportation are provided in the cooling pipe, a sufficiently high and uniform compression is likewise not possible.

These drawbacks of the cooling system result in a poor crimping stability and insufficient uniformity of the yarn, even if the feeding of the thread, the compression of the wadding and the transportation of the wadding in the heating chamber meet all other requirements.

The invention provides a method in which there is first a crimping of the threads in fine arcs, then recrimping the thread in the form of a highly compressed plug wadding using means of transportation both in the heating zone and in the cooling zone. The invention is characterized specifically by the following successive processing steps:

a. heating the texturizing thread in known manner up to the center of the cross section, for example, by means of heated rollers;
b. preliminary crimping of the threads, for example, by starting the shrinking in differently shrinking threads (bicomponent threads), throwing against a baffle surface, embossing by means of finely-grooved embossing rollers, deformation between the tooth edges of gear wheels or in air or steam nozzles;
c. production of a wadding from the precrimped threads;
d. great compression of the wadding by reducing its volume;
e. heat treatment of the highly compressed wadding by transporting the wadding through a heating zone and thereafter a cooling zone, and finally
f. if necessary, reducing the crimping by a following heating zone in order to obtain a yarn of reduced stretchability, but high elasticity, that is, of great crimping stability.

Due to this sequence of production and processing steps, a number of essential advantages are achieved, compared to the known or suggested texturing methods suitable for high speeds.

Due to the precrimping stage, finely curved crimps are obtained, more finely curved than it is possible with the known compression chamber methods. But the crimping is not frozen in the state of low bending stresses, as it is the case in the known air impact methods, gear wheel- or embossing, or nozzle blowing methods. Rather the crimping arcs obtained by precrimping according to the invention are again subjected to high bending stresses by forming the thread to a wadding, which is again highly compressed. In this state, the thread is heated again with a sufficiently long stay period, and finally cooled so that the high bending stresses are frozen. This way, a stable finely curved crimps with a high undulation are obtained.

In addition, the wadding is compressed much more by the subsequent reduction of its cross section than in the known compression chamber methods, namely, both in the heating zone and in the cooling zone. This way, substantially higher bending stresses can be produced and frozen than in the known compression chamber methods. The threads have therefore a much higher elasticity and stretchability than the textured threads produced according to the known methods for high speeds.

Means of transportation are used not only in the heating zone, but in the cooling zone as well. This way, a strong and particularly uniform compression of the wadding in the heating zone and in the cooling zone is possible, even at very high speeds. The yarns have therefore a high degree of uniformity.

Due to the higher speeds achieved in the suggested invention, the method is suitable for a combined spinning, stretching- and texturizing process, which is only economical at sufficiently high texturing speeds. The method is also suitable for a combined spinning and texturizing process which requires even higher speeds.

Because of the great elasticity (crimping stability) of the yarns produced according to the present invention, they can also be wound very hard. This is indispensible at high speeds.

Accordingly, it is an object of the invention to provide a method of treating synthetic threads, particularly filaments or foil threads which comprises heating the threads, crimping the heated threads, forming the crimped threads into a wadding, heating and compressing the wadding to reduce its volume, and thereafter cooling the compressed wadding. A further object of the invention is to provide an apparatus for treating yarn which includes a continuous heating chamber arranged adjacent a continuous cooling chamber, and means for feeding yarn to be treated towards the heating chamber and to crimp the yarn before it arrives at the chamber and to form the crimped yarn into a wadding and to subsequently feeding the wadding through the heating chamber, and which also includes means associated with the heating chamber for compressing the wadding as it is moved therethrough and for transferring it in a compressed state through a portion of the heating chamber and the cooling chamber.

A further object of the invention is to provide an apparatus for treating yarn which is simple in design, rugged in construction and economical to manufacture.

The various features of novelty which characterize the invention are pointed out with particularity in the claims annexted to and forming a part of this disclosure. For a better understanding of the invention, its operating advantages and specific objects attained by its uses, reference should be had to the accompanying drawing and descriptive matter in which there are illustrated preferred embodiments of the invention.

BRIEF DESCRIPTION OF THE DRAWINGS

In the drawings:

FIG. 2 is a partial cross-sectional view of the heating device shown in FIG. 1;

FIG. 3 is a further detail of the sectional view shown in FIG. 2;

FIG. 4 is a partial view similar to FIG. 1, but showing another embodiment of the invention; and FIG. 5 is a view similar to FIG. 1 of still another embodiment of the invention.

GENERAL DESCRIPTION OF THE PREFERRED EMBODIMENTS

Figure 1:
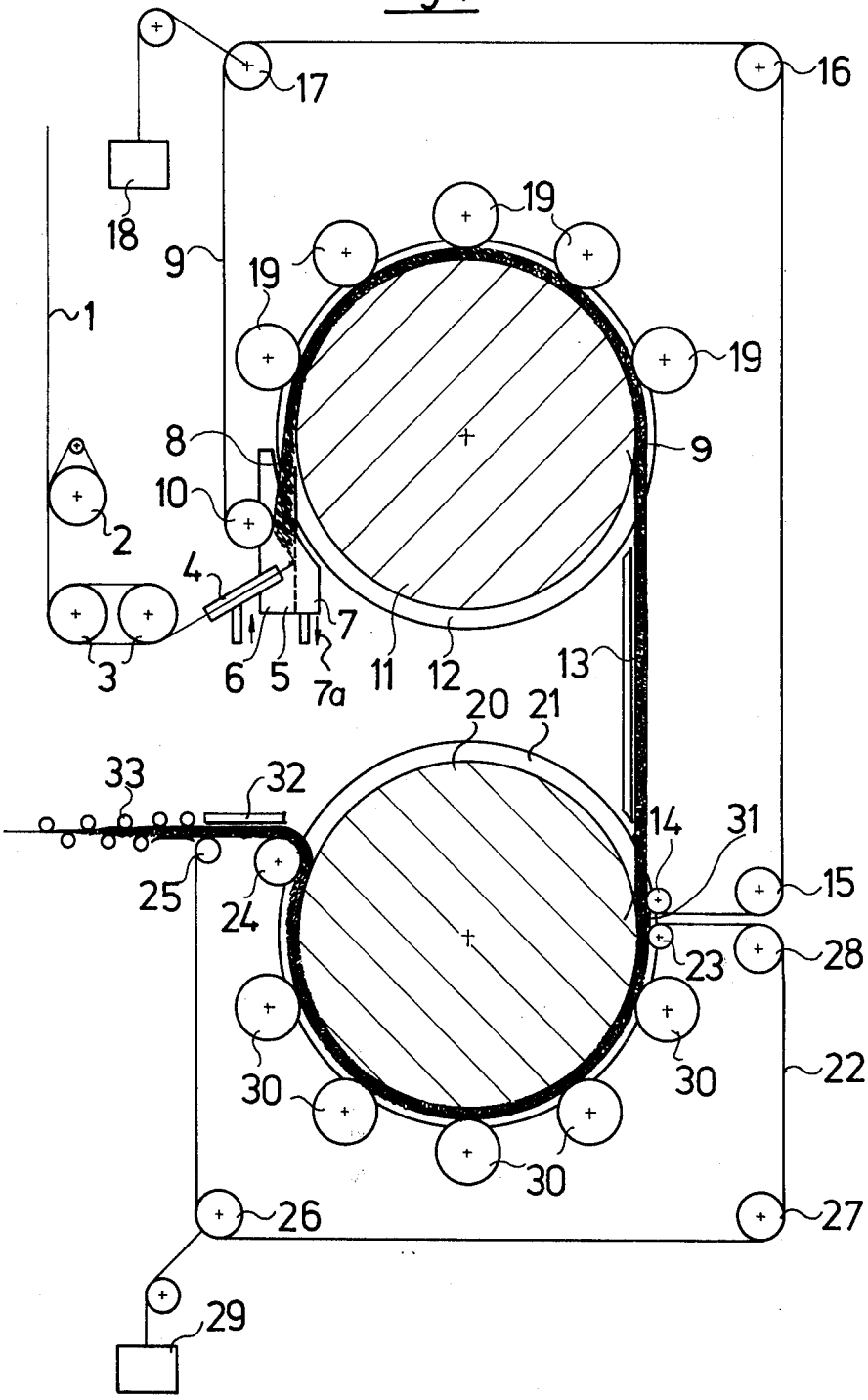
FIG. 1 is a partial sectional and partially schematic guide ram of a crimping apparatus constructed in accordance with the invention.

Referring to the drawings, in particular the invention embodied therein in FIG. 1, comprises a device for treating yarn or thread 1 which is fed through a path in which it is stretched between a heated roller 2 and a set of heated twin rollers 3 and then directed into association with crimping means which, in the embodiment illustrated, comprises a nozzle 4 supplied with a fluid pressure such as air so as to direct the thread against a screen wall 5 of a chamber 6 in order to crimp it. Nozzle 4 may be supplied with a fluid such as air or a heated or unheated gas or steam. The flow medium passes through the screen 5 and is withdrawn from a chamber 7 through an outlet, as indicated by the arrow 7*a*. The fiber or thread 1 bounces back from the screen wall and, in so doing, becomes crimped and is formed into a wadding 8 which is collected between the side walls and the bottom of a duct 6 and a moving belt 9 which is trained to run over a roller 10 and thus form one wall of the exit to the duct 6 which leads into a heating chamber 12. Air current from the nozzle 4 pushes the wadding ahead and prevents it from reaching the point of impact. In some cases the thread 1 is embossed before it is directed against the screen 5.

The belt 9 is preferably provided with short pins which project outwardly from its surface and which engage into the wadding so as to positively advance it through the annular heating duct 12 which is formed around the surface of a rotating drum or disc 11 between the belt and the surface of the drum. The wadding, which is formed is moved around the heating disc by about 180° and runs parallel to a guide bar 13 up to a guide roller 14 located at the entrance to a cooling chamber 21 defined around the surface of a second rotating disc 20 and between it and a second belt 22. The belt 9 returns over rollers 15, 16, 17. The wadding 8 is clamped between the belt and the walls of the heating duct 12 and is highly compressed therebetween.

In order to produce a constant pressure in the wadding 8, the belt 9 is loaded constantly, for example, by means of a weight 18. The loading, of course, can also be effected by means of a spring force (not shown). The compression is further increased by pressure rolls 19 when desired. Wadding 8 is lifted off the surface of the heating drum 11 by the guide bar 13 moved to the rotating cooling disc 20 in the cooling chamber 21.

The guide bar 13 is preferably heated. This insures the freezing of the bending stresses under exactly defined conditions in the cooling chamber 21. The belt 22 runs in spaced location to the periphery of the drum 20 in the cooling chamber 21 and it gets into the cooling chamber 21 at the location of guide roller 23 and passes around about 180° and returns over guide rollers 24, 25, 26, 27, and 28. A weight 29 acts on the belt 22 so as to provide a constant loading of the wadding. Additional pressure rolls 30 are provided in order to increase the bending stresses in the wadding.

In order to insure the transfer of the wadding from the belt 9 to the belt 22, the apparatus includes a guide plate 31 provided between the guide rollers 14 and 23. The wadding is removed from the cooling chamber 20 by means of a guide bar 32. It is loosened by a loosening device 33 formed of several friction rods. Due to the adequate cooling, the thread is relatively insensitive to tensile stresses. Naturally, other arrangements of heating disc and cooling disc relative to each other are possible. For example, both discs can be displaced relative to each other so that the wadding passes through the discs in opposite directions of rotation.

FIG. 2 shows the outer range of the disc-shaped heating chamber or cooling chamber in a vertical section. The heating is effected preferably with hot air or steam which is directed through the duct. The cooling, however, is effected preferably with room air or cold air. The air or steam is conducted through a rotating inlet (not shown) arranged in the disc center and extends through ducts extending radially through the outside into the ring grooves 35 defined between an outer covering 35*a* and the inner surface of the groove 35. The heating or cooling medium flows through bores 37 or a porous coat of sintered metal into the heating chambers or cooling chambers as the case may be where it issues and is removed again through an annular groove 38 and the ducts 39.

The ducts 39 are not needed when the flow medium enters through the bottom of the duct and is removed through the side walls through the outside into the chamber surrounding the heating disc or cooling disc. The regions of the heating or cooling ducts in which the wadding does not run are sealed from the inside or outside. This type of heating or cooling insures a good heat transfer to the threads. Beyond that, it is also possible, for example, to heat the heating chamber walls by means of heating cartridges, strip heaters or diphyl. In this case, the belt 9 should also be heated, for example, by inductance. In FIG. 2, four heating ducts are arranged side by side in a heating disc. This number can be increased, if desired.

FIG. 3 shows a large portion of the heating duct 35. The bottom surface of the duct contains several narrow grooves 30. These grooves are engaged by the forked ends 41 of the bars 13 and 32 as they lift the wadding from the bottom of the groove to remove it from the rotating disc 11 or 20.

FIG. 4 indicates another embodiment of the invention wherein the precrimping is produced with an embossing roll 42 provided with very fine grooves which press against a roll 43 provided with an elastic covering. The thread is subsequently fed into the compression duct 46 by means of perforated rolls 44 and 45 which are biased together. Air is blown through the interior of the rolls 44 and 45, and it may be heated in order to avoid lap formation at high speeds. The belt 9 dips into the duct 46 and introduces the wadding for subsequent compression into the heating duct 12. It is also possible to provide the last of the twin rollers 3 with fine grooves in order to save the roll 42.

The invention may be carried out with a combination of air impact and embossing to effect crimping if desired. Such a case in embossing roll is arranged ahead of the crimping apparatus comprising the nozzle 4, as shown in FIG. 1, or the last of the twin rollers 3 is provided with grooves for effecting the embossing.

FIG. 5 shows another embodiment in which thread 1 is stretched first by heated rollers and is heated. The heated thread is then thrown against a screen wall 47 after leaving the nozzle 4'. By this action, it is crimped. Thread bouncing back from the screen is formed into a wad 8 which is gripped between needles 48 of a revolving belt. Since the belt rotates at a lower speed than the thread is supplied, the precrimped thread forms a wadding 8 between the needles. The needles transport the wadding 8 into the heating duct formed between spaced walls 50 and 50'. Walls 50 and 50' taper together after the entrance of the wadding 8 so that the wadding is compressed. The compressed state wadding is then passed between spaced walls 51 and 51' which define a cooling chamber therebetween for the cooling of the wadding. The needles 48 ensure a uniformly high compression during the passage through the heating and cooling ducts. Belt 49 receives its drive from a roller 52 and it is reversed over a roller 53. The end of the cooling duct is designed so that the needles retract slowly from the duct. After issuing from the cooling duct, the wadding 8 is dissolved again by means of a dissolving device 54. It is also possible to utilize both sides of the needle belt to dissolve the wadding again in the proximity of the thread supply.

While specific embodiments of the invention have been shown and described in detail to illustrate the application of the principles of the invention, it will be understood that the invention may be embodied otherwise without departing from such principles.

What is claimed is:

1. A method for treating synthetic threads particularly filament or foil threads using a mechanical means for transporting the threads, comprising subjecting the threads to a preliminary heating and stretching, crimping the threads by directing the threads with a fluid pressure against a screen permitting the threads to bounce off the screen and form crimped threads, forming the crimped threads into a wadding, compacting the wadding, heating the compacted wadding and transporting it with the mechanical means, and cooling the wadding as it is being transported.

2. A method according to claim 1, including embossing the threads before they are directed against the screen.

3. A method according to claim 1, wherein the wadding is compressed by directing the wadding between two convergent walls and including maintaining the compressed wadding under pressure as it is heated.

4. A method according to claim 1, wherein wadding is directed onto a rotating drum and a belt is moved into contact with the outer surface of the wadding to compress it onto the drum and hold it on the drum as it is heated.

5. A method according to claim 4, including passing the wadding to a second drum after it has been heated and rotating the drum to move the wadding while it is cool.

6. A method according to claim 1, wherein the wadding is compressed while it is being heated and while it is being cooled.

7. An apparatus for treating yarn comprising means defining a continuous heating chamber, means defining a continuous cooling chamber adjacent said heating chamber, means for stretching and feeding yarn to be treated toward said heating chamber, crimping means along the feed path of the yarn for crimping the yarn, means adjacent said crimping means for forming the crimped yarn into a wadding, mechanical means for positively advancing the wadding through said heating chamber and said cooling chamber, means associated with said heating chamber for compressing the wadding as it is moved therein so that it is transferred in a compressed state through a portion of said heating chamber and said cooling chamber, means in said heating chamber for heating said wadding and means in said cooling chamber for cooling said wadding.

8. An apparatus for treating yarn comprising means defining a continuous heating chamber, means defining a continuous cooling chamber adjacent said heating chamber, means for feeding yarn to be treated toward said heating chamber, crimping means along the feed path of the yarn for crimping the yarn, means adjacent said crimping means for forming the crimped yarn into a wadding, means for advancing the wadding through said heating chamber and said cooling chamber, means associated with said heating chamber for compressing the wadding as it is moved therein so that it is transferred in a compressed state through a portion of said heating chamber and said cooling chamber, means in said heating chamber for heating said wadding and means in said cooling chamber for cooling said wadding, a rotatable heating disc and a rotatable cooling disc, said respective heating and cooling chambers being defined as an annular space around the surface of said heating and cooling disc, respectively, a belt trained to run around the surface of said heating disc and said cooling disc and to hold the wadding on said disc between said belt and said associated discs, and transfer means between said heating disc and said cooling disc for transferring the heated wadding to the cooling disc for cooling thereon.

9. An apparatus according to claim 8, wherein said heating and cooling discs each have annular ducts therearound for respective heating and cooling medium, and means for supplying the heating and cooling medium to the respective grooves of said heating and cooling discs.

10. An apparatus according to claim 9, wherein the means for supplying heating and cooling medium includes the bore defined in said disc arranged coaxially to the axis of rotation thereof and connecting into the associated heating and cooling duct, said transfer means comprising means for lifting the wadding out of the ducts defined in said grooves after it is passed over the surface of said heating and cooling discs.

11. An apparatus for treating yarn comprising means defining a continuous heating chamber, means defining a continuous cooling chamber adjacent said heating chamber, means for feeding yarn to be treated toward said heating chamber, crimping means along the feed path of the yarn for crimping the yarn, means adjacent said crimping means for forming the crimped yarn into a wadding means for advancing the wadding through said heating chamber and said cooling chamber, means associated with said heating chamber for compressing the wadding as it is moved therein so that it is transferred in a compressed state through a portion of said heating chamber and said cooling chamber, means in said heating chamber for heating said wadding and means in said cooling chamber for cooling said wadding, said heating and cooling chambers containing a sintered metal material therein defining the porous material through which the heating and cooling medium may flow.

12. An apparatus for treating yarn comprising means defining a continuous heating chamber, means defining a continuous cooling chamber adjacent said heating chamber, means for feeding yarn to be treated toward said heating chamber, crimping means along the feed path of the yarn for crimping the yarn, means adjacent said crimping means for forming the crimped yarn into a wadding, means for advancing the wadding through said heating chamber and said cooling chamber, means associated with said heating chamber for compressing the wadding as it is moved therein so that it is transferred in a compressed state through a portion of said heating chamber and said cooling chamber, means in said heating chamber for heating said wadding and means in said cooling chamber for cooling said wadding, said heating and cooling disc each including a surface having a plurality of annular grooves defined therearound, said disc also having passages for cooling medium to said grooves and a transfer guide bar extending between said heating duct and said cooling duct and being located so as to engage against the periphery of the associated discs into the grooves thereof to lift the wadding of the grooves during transfer.

13. An apparatus for treating yarn comprising means defining a continuous heating chamber, means defining a continuous cooling chamber adjacent said heating chamber, means for feeding yarn to be treated toward said heating chamber, crimping means along the feed path of the yarn for crimping the yarn, means adjacent said crimping means for forming the crimped yarn into a wadding, means for advancing the wadding through said heating chamber and said cooling chamber, means associated with said heating chamber for compressing the wadding as it is moved therein so that it is transferred in a compressed state through a portion of said heating chamber and said cooling chamber, means in said heating chamber for heating said wadding and means in said cooling chamber for cooling said wadding, a continuous belt, first and second spaced apart walls defining the heating chamber and a cooling chamber therebetween extending along a feed path for said wadding, said endless belt having a reach with outwardly projecting needles movable through a path intercepting said heating chamber and said cooling chamber, means for moving said belt, said crimping means being arranged to crimp material adjacent the periphery of said belt for feeding between the needles thereof, said belt being movable at a slow enough speed to permit the wadding to accumulate between needles, said spaced wall defining said heating and cooling chambers therebetween including divergent portions for compressing the wadding as it is moved between said walls by movement of said belt with said nozzles.

14. An apparatus according to claim 13, wherein said needles move through openings of one of said walls and are arranged so that the needles move out of the openings at the end of the cooling chamber defined between said walls.

* * * * *